US005816908A

United States Patent [19]

Tsou

[11] Patent Number: 5,816,908

[45] Date of Patent: Oct. 6, 1998

[54] AIR SHOWER FOR A CLEAN ROOM SYSTEM

[75] Inventor: Hsin-Yi Tsou, Kaohsiung, Taiwan

[73] Assignee: Chu Kuo Air-Con Engineering Co., Ltd., Kaohsiung, Taiwan

[21] Appl. No.: 884,769

[22] Filed: Jun. 30, 1997

[51] Int. Cl.[6] ..... F24F 7/10

[52] U.S. Cl. ..... 454/187; 52/79.4

[58] Field of Search ..... 52/79.4; 454/187, 454/228, 230, 233, 236, 237, 251

[56] References Cited

U.S. PATENT DOCUMENTS

| | | | |
|---|---|---|---|
| 3,633,325 | 1/1972 | Bartoli | 52/79.4 X |
| 4,409,889 | 10/1983 | Burleson | 454/187 |
| 4,501,099 | 2/1985 | Boaz | 52/79.4 X |
| 4,672,779 | 6/1987 | Boyd | 52/79.4 |
| 4,967,645 | 11/1990 | Mattson | 454/187 X |
| 5,360,372 | 11/1994 | Newman et al. | 454/253 |
| 5,690,234 | 11/1997 | Rhead et al. | 52/79.4 X |
| 5,692,954 | 12/1997 | Lee et al. | 454/187 |

FOREIGN PATENT DOCUMENTS

| | | | |
|---|---|---|---|
| 3387 | 5/1911 | United Kingdom | 52/79.4 |

*Primary Examiner*—Harold Joyce

[57] ABSTRACT

An air shower for a clean room system, having an assembly and knockdown architecture. The assembly and knockdown architecture means an air shower is formed from a plurality of elementary components with standard specification in size. The air shower primarily comprises two main cases, one top case and one bottom case. The top and bottom cases are two rectangular parallelepipeds. Each parallelepiped consists of two right triangle cases and one isosceles triangle case. By means of the arrangement of these two top and bottom cases, an air shower can be formed with octagon shape or tunnel type. This gives the number of people stepping into or getting out of an air shower more flexibility, and increasing or decreasing the number of the installed devices can be dependent of the volume of the business. Meanwhile, the configuration of the space for an air shower is adjustable.

14 Claims, 5 Drawing Sheets

AIR SHOWER FOR A CLEAN ROOM SYSTEM

BACKGROUND OF THE INVENTION

1. Field of the Invention

The present invention relates to an air shower for a clean room system. More particularly, the present invention relates to an air shower having an assembly and knockdown architecture for a clean room system. The assembly and knockdown architecture means an air shower is formed from a plurality of elementary components with standard specification in size.

2. Prior Art Description

During the past few years, an air shower is commonly used to prevent clean room from being contaminated by dirt or bacteria in some areas, such as electronic and electrical industry, 20 food industry, medical environment, computer room, hospital, printed industry, high technology industry, . . . etc. People to get into or objects to be placed in a clean room, it is necessary to put them in an air shower first, then they are allowed to be in the clean room. In general, an air shower is installed at the entrance of a clean room to achieve the following functions: (a) airlock (b) watch out the people who is getting into and getting out (c) take dirt or bacteria away from people or objects at a speed of 20–25 m/sec. There are two types of air shower for use on people and on objects. For model on people, there are some characteristics, such as: (a) When a person steps into the room and closes the door behind him, the air jet diffusers the sensor will blow the air on him at a speed of 20–25 m/sec and blow away the dust and bacteria on him in a very short time. The contaminated air will flow into the pre-filter at the bottom and after it has gone through HEAP filter, it will be recirculated into the room. The cleaning time can be controlled by a timer, for instance, which can be adjusted from 0 to 60 seconds. For model on objects, basically it is similar to the model for people. The directions of air jet diffusers can be designed to meet specific requirements, and the dimensions can be made to suit special conditions and objects' requirements.

Nowadays, people pay more attention about the air quality of their working rooms. The class for clean room is getting more popular. A variety of specifications for air showers are designed for particular conditions or requirements. A conventional air shower has a rectangular parallelepiped with two doors. One door is used as an entrance, the other door is used as an exit and connected to a clean room. There are a plurality of air jet nozzles in an air shower. They are installed on the top surface, left-hand surface and right hand-hand surface. When a person steps into the room and closes the door behind him, the air jet diffusers the sensor will blow the air on him at a speed of 20–25 m/sec and blow away the dust and bacteria on him in a very short time. After it is done, people get into the clean room via the other door. During the period of the air shower being used, there is only one person can use this air shower. People who use the air shower must wait until the air shower is available. Therefore, it will be very crowded during the time periods of clock-in for persons to get into the office and clock-out for persons to leave the office. Hence, it will be employed a plurality of air showers to release the crowded phenomena in conventional ways. However, increasing one air shower only can increase one person to use it at the same time, because the air shower is made by way of single unit and without capability of expansion in accordance with conventional air shower. This limits the advantage of an air shower. There is no standard specification of the dimension in size for an air shower yet. Different components and dimensions are employed for an air shower to meet specific requirements, such as the width and height of a hall, room, storage, house, plant, . . . etc., in order to get into or get out of a building. Moreover, in accordance with conventional air shower, the air shower can not be assembled and knockdown. Hence, once installed, it is hard to adjust for expansion or another purposes.

SUMMARY OF THE INVENTION

The primary objective of the present invention is to provide an air shower to overcome the aforementioned drawback of the conventional air shower. In accordance with one aspect of the present invention, there is provided an air shower having an assembly and knocked own architecture for a clean room system. This makes increasing or decreasing the number of the installed air showers more flexible. Meanwhile, the configuration of the space for an air shower is adjustable, and the advantage of the installation for an air shower is improved.

The other objective of the present invention is to provide an air shower which is formed by a plurality of elementary components with standard specification in size. More than one air showers may be connected together in series or by shape, and share one common control circuitry. Meanwhile, they will look more beautiful because of the uniform design. The specification described herein provides some embodiments, and can also be used as elementary building blocks in the design of more expanded techniques in accordance with the present invention. It might give the design a lower cost to an architect by means of these elementary samples that covers the expanded design. Moreover, it is not necessary to hire specialist to install the air showers. They can be arranged and assembled by an ordinary technician. Thus, extra cost is cut down.

Accordingly, the architecture presented here for air shower can be formed by a plurality of elementary components with standard specification Generally speaking, an air shower comprises two main cases, one top case, and one bottom case. The top and bottom cases are two rectangular parallelepipeds. Each parallelepiped consists of two right triangle cases and one isosceles triangle case. By means of the arrangement of these two top and bottom cases, an air shower is formed with octagon shape or tunnel type. This gives the number of people stepping into or getting out of an air shower more flexibility, and increasing or decreasing the number of the installed air showers can be dependent of the volume of the business. Meanwhile, the configuration of the space for an air shower is adjustable.

Another objective of the present invention is to provide an air shower which can be formed by three sets of elementary architecture and two sets of doors, and is in octagon shape or tunneling type. Moreover, the entrance door and exit door of the air shower can be installed anywhere as needed, so that the space for 4 people stepping into or getting out of an air shower can be used for 6 up to 8 people in accordance with this octagon shape assembly architecture, or without the limitation of the number of people stepping into or getting out of an air shower in accordance with tunnel type assembly architecture. Therefore, the crowded phenomenon during the time periods of clock-in for persons to get into the office and clock-out for persons to leave the office will be eliminated. Customers will also save money for buying extra materials.

Further objectives and advantages of the present invention will become apparent from a careful reading of a detailed description provided herein below, with appropriate reference to accompanying drawings.

DETAILED DESCRIPTION OF THE PREFERRED EMBODIMENT

Figure 1:
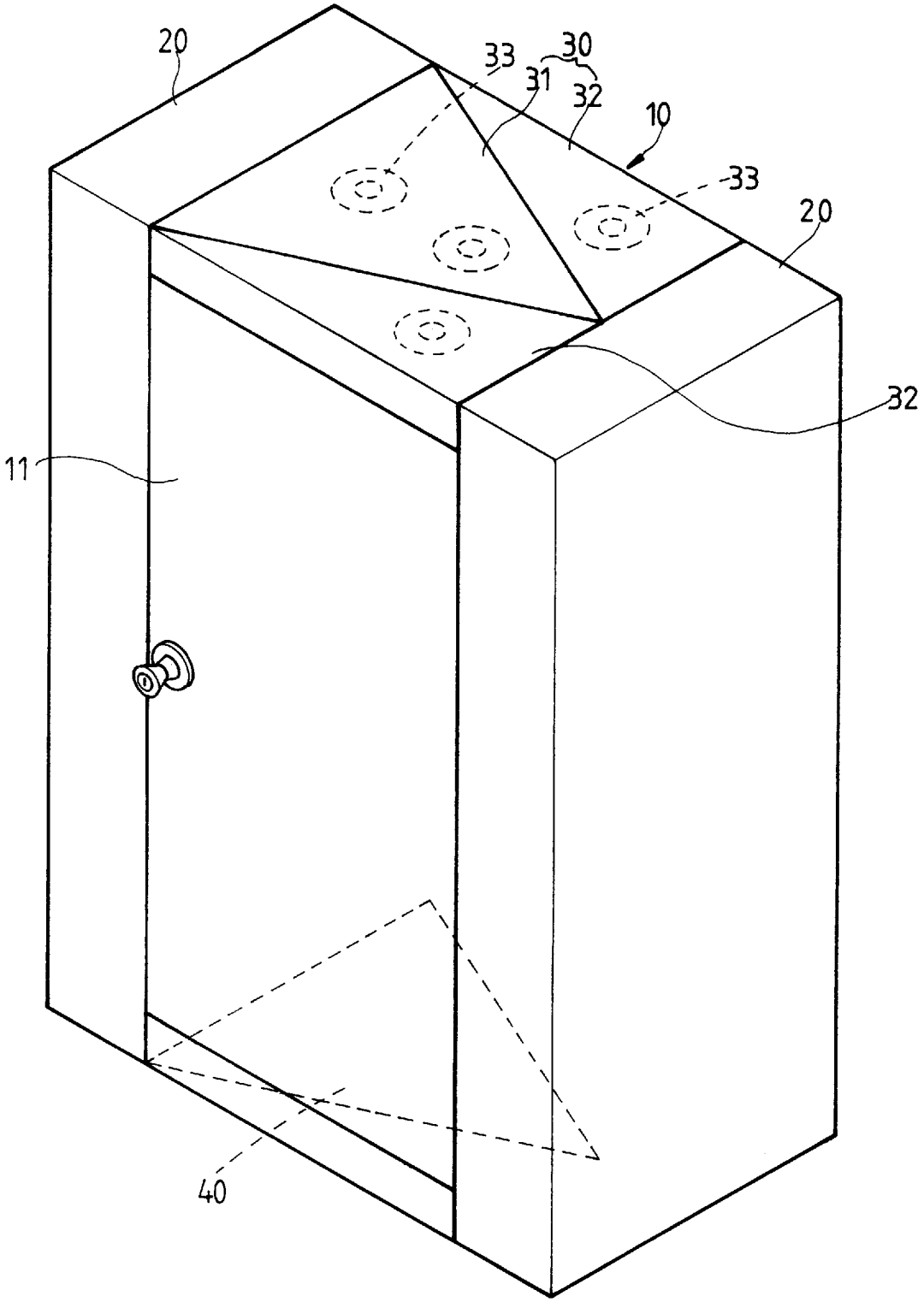
FIG. 1 is an overview showing an air shower in accordance with the present invention.
Figure 2:
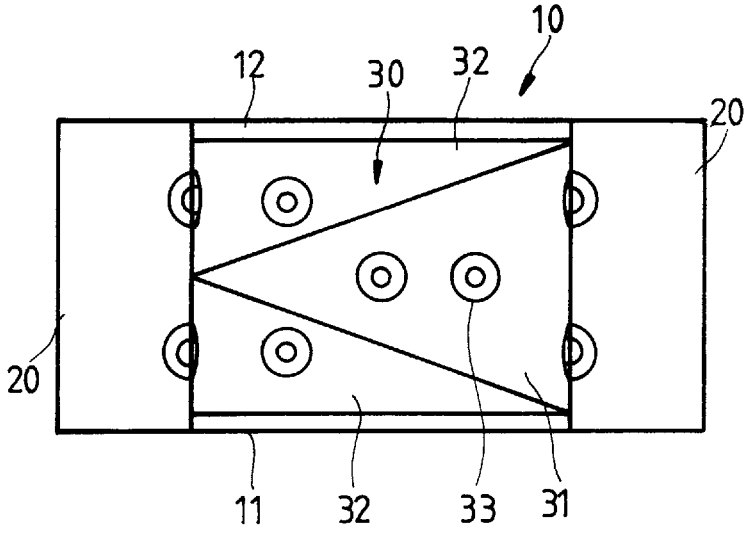
FIG. 2 is the top view of FIG. 1.

Referring to the drawings, and FIG. 1 is an overview showing an air shower in accordance with the present invention. FIG. 2 is the top view of FIG. 1. Basically, an air shower 10 according to the present invention is assembled by a plurality of elementary components with standard specification in size, and primarily comprises two main cases 20, one top case 30, and one bottom case 40. Both the top case 30 and the bottom case 40 are with the same structure. Each case is formed by one isosceles triangle case 31 and two right triangular cases 32. For the top case 30, there are a plurality of air jet nozzles on these triangle cases. For the bottom case, there is no air jet nozzle, because people will step on it. The isosceles triangle case 31 is between two right triangle cases 32. This gives the top case 30 and bottom case two rectangular parallelepipeds. There is an entrance door 11 in the front side of the air shower, and an exit door 12 is at the opposite side (not shown in the drawings). All the components of these two main cases 20, one top case 30, and bottom case 40 (including one isosceles triangle case 31 and two right triangle cases 32) are secured and assembled by bolts, and the leakage therebetween is filled with silicon. This make the whole air shower a space of closed form.

Figure 3:
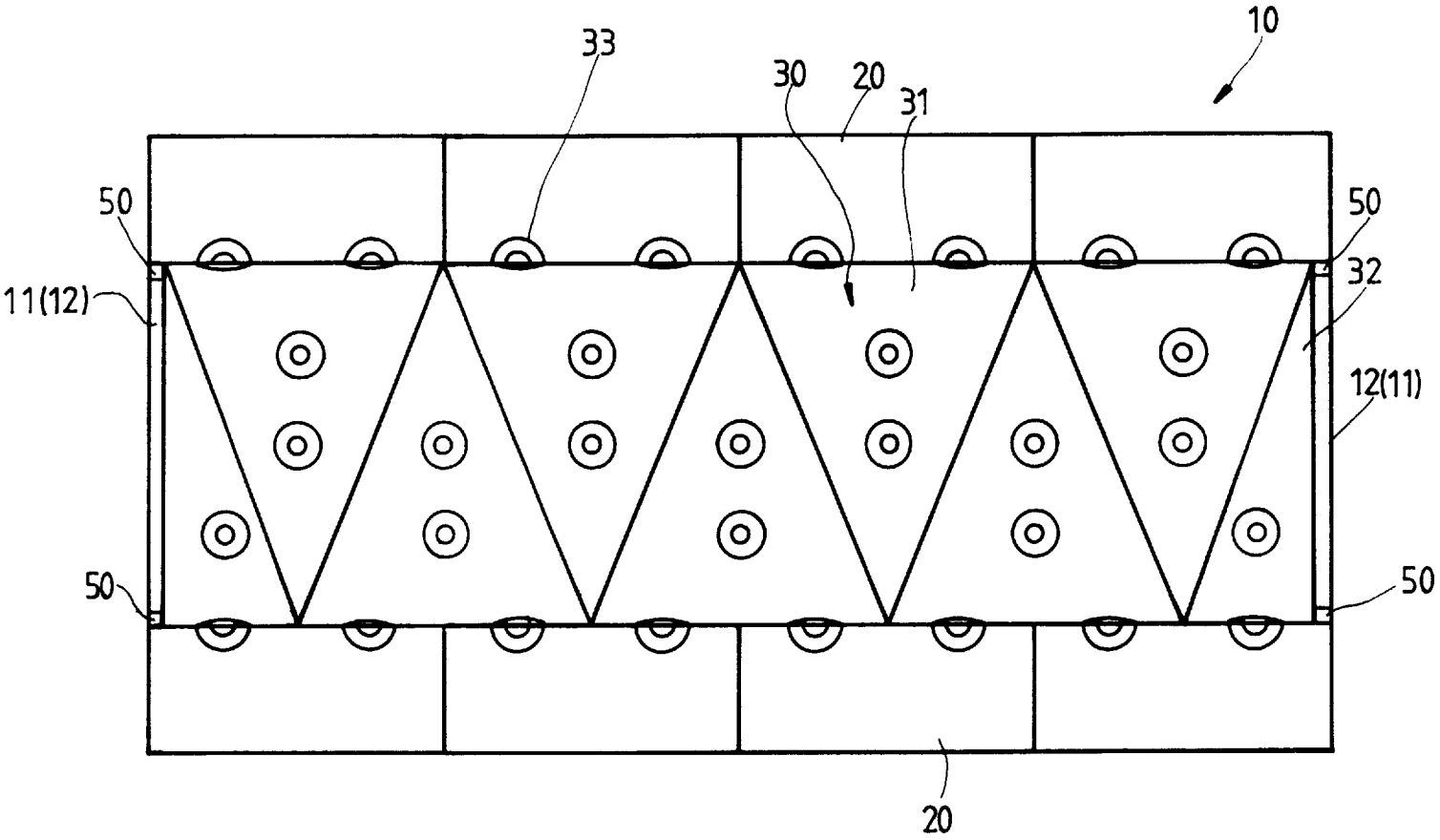
FIG. 3 is a first embodiment in accordance with the present invention, which is illustrated by the top view.

Referring next to FIG. 3, illustrated is a first embodiment in accordance with the present invention. It shows an expanded case according to the present invention, and which is represented by the top view in order to emphasis the effect of the characteristic of the assembly architecture. Since an air shower 10 is formed by a plurality of elementary components with standard specification in size in accordance with the present invention, FIG. 3 can be obtained by the expansion of four air showers 10 as shown in FIG. 1. In the process of assembly, one of the doors of an outermost air shower is removed, and be shifted to the fourth air shower 10. This expansion yields a wholly open tunnel, and the top case 30 of rectangular parallelepiped (similar to the bottom case can be formed by five isosceles triangle cases 31 and two right triangle cases 32. All the components of these two main cases 20, the top case 30, and the bottom case 40 (including one isosceles triangle case 31 and two right triangle cases 32) are secured and assembled by bolts, and the leakage therebetween is filled with silicon. This make the whole air shower 10 a space of closed form and in line type. By comparing this air shower with the conventional air showers, it is seen that four independent air showers in line type are needed by means of conventional architecture, and there are at most four people to use the conventional air showers at the same time. However, there will be six people to use an air shower (one isosceles triangle 31 can be stepped by one people) at the same time according to this embodiment. Moreover, since a wholly open tunnel is provided, there are spaces available for people to move. People stepping into the air shower can sequentially get out from the opposite door along this tunnel. During people's moving, Air are blown toward them via air jet nozzles and carry away dust and bacteria in a very short time. Therefore, the crowded phenomenon will be eliminated, and the utilization for an air shower is also improved.

Figure 4:
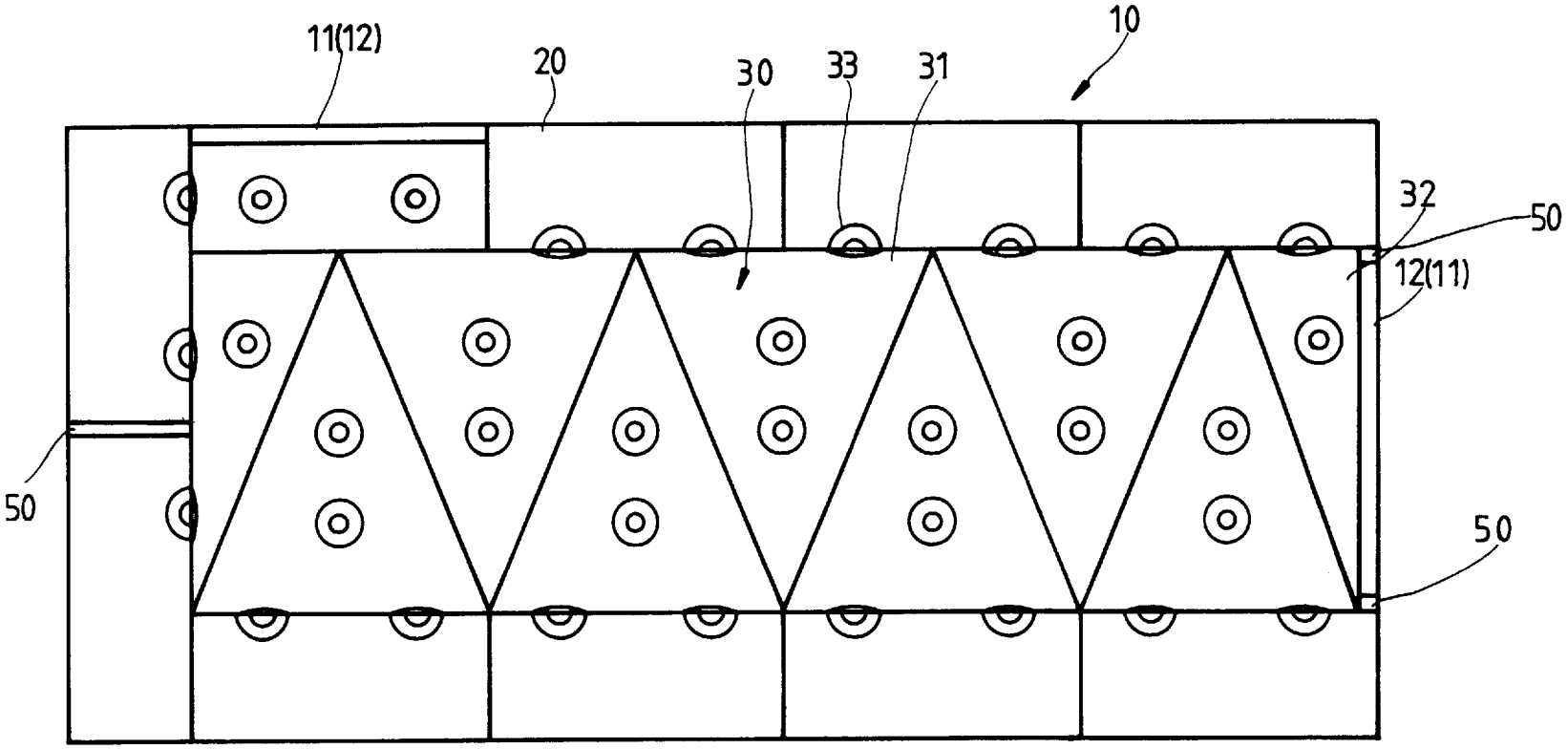
FIG. 4 is a second embodiment in accordance with the present invention, which is illustrated by the top view.

Referring next to FIG. 4, illustrated is a second embodiment in accordance with the present invention. Basically, the second embodiment is similar to the first one. It is assembled by four air showers 10, and one main case 20 is added on. Both the top case 30 and the bottom case 40 are lined up with isosceles triangle cases 31, and right triangle cases 32 are at two outermost sides. This expansion yields a wholly open tunnel, in which an entrance door 11 is installed on the main case 20, and perpendicular to the exit door 12. This make the whole air shower 10 be an L-type tunnel. Entrance door 11 and exit door 12 may be installed at anywhere as needed, and it thus is more convenient to be installed at a room of a plant. Meanwhile, the configuration of the space for an air shower is adjustable, and the advantage of the installation for an air shower is improved.

Figure 5:
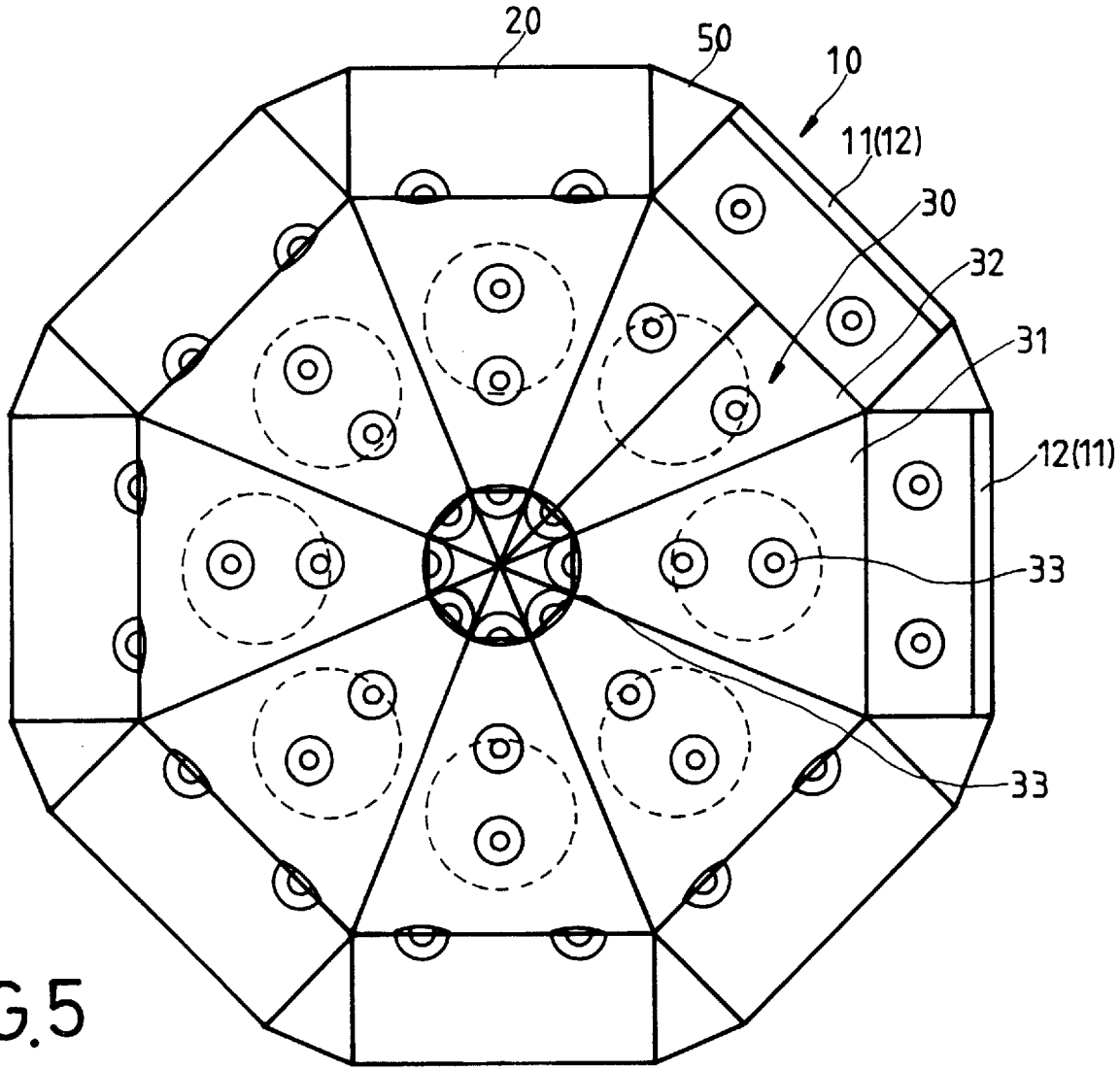
FIG. 5 is a third embodiment in accordance with the present invention, which is illustrated by the top view.

Referring next to FIG. 5, illustrated is a third embodiment in accordance with the present invention. The aforementioned embodiments are assembled in tunnel type. In the embodiment shown in FIG. 5, an air shower 10 in octagon shape is assembled by the same number of top cases 30, bottom cases 40 and main cases 20. In the process of assembly, six main cases 20 are symmetrically arranged in octagon shape, in which each isosceles triangle case 31 is correspondent to a main box 20, and this assembly make the whole air shower 10 be in closed form. At the center of the air shower, a set of air exit in octagon shape is added and installed in order to have air jet nozzles 33 on both right hand side and left hand side. Dead corner is thus eliminated. Since the main case is in rectangle shape, there will be a triangular leakage between any two adjacent main cases. This can be sealed with a cover case 50. Similarly, all components are secured and assembled by bolts, and the leakage therebetween will be filled with silicon. This make the whole air shower a space of closed form. As shown in the FIG. 5, each circle (in dot line) indicates where one person may step on it. For this embodiment, eight people may step on the eight isosceles triangle cases 31. At the end of the front side of each isosceles triangle case 31, an air jet nozzles 33 is added on and installed. Therefore, it blow air onto the people at a high speed on both sides. The two doors may be installed at any two sides of this octagon. People stepping into the air shower via an entrance door can sequentially get out from the exit door along this octagon. It can be seen that the crowded phenomenon will be eliminated by means of such kind of circular movement, and the utilization for an air shower is also improved. Thus there is no limitation of the number of people stepping into or getting out of an air shower in accordance with the octagon type assembly architecture.

Since the aforementioned drawbacks of the conventional architecture for an air shower are obvious, it becomes the primary objective of the present invention to employ an improved way to mitigate and/or obviate these disadvantages of the conventional architecture. Having fully described the preferred embodiments of the invention and various alternatives, we have seen that an air shower in accordance with the invention can be formed by a plurality of elementary components with standard specification in size, and have an assembly knockdown architecture. By means of the geometric arrangement of the top and bottom cases, an air shower can be formed with octagon shape or tunnel type. This gives the number of people stepping into or getting out of an air shower more flexibility, and increasing or decreasing the number of the installed devices is dependent of the volume of the business. Meanwhile, the configuration of the space for an air shower is adjustable.

Although this invention has been described with a certain degree of particularity, it is to be understood that the present disclosure has been made by way of preferred embodiments only and that numerous changes in the detailed construction and combination and arrangement of parts may be restored to without departing from the spirit and scope of the invention as hereinafter set forth.

We claim:

1. An air shower for a clean room system, having knockdown architecture comprising:

two main cases;

one top case;

one bottom case; and a plurality of doors;

in which said main cases, said top case, and said bottom case are secured and assembled by bolts, both said top case and bottom case have the same architecture, and are formed from a plurality of elementary components with standard specification in size each of said elementary components include two right triangle cases, and one isosceles triangle case in which said isosceles triangle case is between two said right triangle cases, and said elementary component is formed with a rectangular parallelepiped, and one of said doors is used as an entrance, and one of said doors is an exit connected to said clean room.

2. The air shower as set forth in claim 1 in which by means of the geometric arrangement of said top case and bottom case, said air shower is formed with octagon shape.

3. The air shower as set forth in claim 1 in which by means of the geometric arrangement of said top case and bottom case, said air shower is formed with tunnel type.

4. The air shower as set forth in claim 2 in which silicon is filled between adjacent cases of said air shower.

5. The air shower as set forth in claim 3 in which silicon is filled between adjacent cases of said air shower.

6. The air shower as set forth in claim 4 in which said air shower is formed by the same number of main case, isosceles triangle case, and right triangle case.

7. The air shower as set forth in claim 5 in which said air shower is formed by the same number of main cases, isosceles triangle cases, and right triangle cases.

8. The air shower as set forth in claim 3 in which said air shower further includes line type and L-type air showers.

9. The air shower as set forth in claim 8 in which said entrance door and exit door of said air shower with line type are lined up and correspondent to each other, said top case and bottom case are lined up with contiguous isosceles triangles, and near two said doors are assembled with right triangles so as to form a wholly open tunnel.

10. The air shower as set forth in claim 8, wherein, said top case and bottom case of said air showers with L-type are lined up with contiguous isosceles triangles, and of which at outermost sides are assembled with right triangles so as to form a wholly open tunnel, in which said entrance door is installed on said main case, and perpendicular to said exit door.

11. The air shower as set forth in claim 2 in which said main cases of said air shower with octagon shape are symmetrically arranged in octagon shape, each said isosceles triangle case is correspondent to a said main box, and said air shower is assembled in closed form.

12. The air shower as set forth in claim 11 in which a triangular leakage is present between any two adjacent main cases which is sealed with a cover case to beautify said air shower.

13. The air shower as set forth in claim 11 in which an air jet nozzle is added and installed on each said isosceles triangle case.

14. The air shower as set forth in claim 11 in which said two doors are installed at any two sides of said octagon.

* * * * *